US006953015B2

(12) United States Patent
Asari et al.

(10) Patent No.: US 6,953,015 B2
(45) Date of Patent: Oct. 11, 2005

(54) ENGINE

(75) Inventors: Masaru Asari, Saitama (JP); Ikuro Hara, Saitama (JP); Kazuaki Shimoyama, Saitama (JP); Hiroshi Takagishi, Saitama (JP)

(73) Assignee: Honda Giken Hogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,842

(22) Filed: Jul. 14, 2003

(65) Prior Publication Data

US 2004/0016414 A1 Jan. 29, 2004

(30) Foreign Application Priority Data

Jul. 23, 2002 (JP) ..... P. 2002-213705
Jul. 23, 2002 (JP) ..... P. 2002-213706

(51) Int. Cl.[7] ..... F01L 1/02

(52) U.S. Cl. ..... 123/90.27; 123/90.31; 123/198 F; 123/193.5

(58) Field of Search ..... 123/90.27, 90.31, 123/90.34, 90.6, 90.16, 90.17, 195 C, 198 F, 193.5, 193.3, 193.4, 193.2

(56) References Cited

U.S. PATENT DOCUMENTS 3,732,745 A * 5/1973 Jackson ..... 74/325
4,671,223 A * 6/1987 Asano et al. ..... 123/90.31
4,674,452 A * 6/1987 Asanomi ..... 123/90.31
4,957,079 A * 9/1990 Nakatani et al. ..... 123/90.34
5,181,485 A * 1/1993 Hirose et al. ..... 123/90.17
2002/0069717 A1 * 6/2002 Knox et al.

FOREIGN PATENT DOCUMENTS

JP 3-117603 5/1999
JP 2000002234 A * 1/2000 ..... F16C/17/04

* cited by examiner

*Primary Examiner*—Thomas Denion
*Assistant Examiner*—Ching Chang
(74) *Attorney, Agent, or Firm*—Arent Fox PLLC

(57) ABSTRACT

An engine has a first camshaft having a power input portion at one end thereof and a second camshaft interlocked and connected with the first camshaft at one end portion thereof have axes which are parallel with each other and are rotatably supported on a cylinder head and in which a driven gear meshing with a drive gear provided at the other end portion of one of the first and second camshafts is provided on an auxiliary device drive shaft connecting to an auxiliary device mounted on an engine main body including the cylinder head, wherein an axis of the auxiliary device drive shaft is disposed between the first and second camshafts at a position closer to the cylinder head than a straight line connecting the axes of the two camshafts.

22 Claims, 8 Drawing Sheets

ENGINE

BACKGROUND OF THE INVENTION

1. Field of the Invention

The present invention relates to an engine in which a first camshaft having a power input portion at one end thereof and a second camshaft interlocked and connected with the first camshaft at one end portion thereof have axes which are parallel with each other and are rotatably supported on a cylinder head and in which a driven gear meshing with a drive gear provided at the other end portion of one of the first and second camshafts is provided on an auxiliary device drive shaft connecting to an auxiliary device mounted on an engine main body including the cylinder head.

The present invention relates an engine in which first and second camshafts having axes which are parallel with each other along a cylinder arrangement direction are rotatably supported by pluralities of first and second bearing portions, respectively, which are provided for the respective camshafts on a cylinder head at positions spaced apart from each other in the cylinder arrangement direction, in which first and second rotational wheels which are interlocked and connected with each other are fixed to the first and second camshafts, respectively, at portions which protrude from the one endmost first and second bearing portions of the pluralities of the first and second bearing portions which are disposed at one end of the cylinder head along the cylinder arrangement direction, and in which a cylindrical protruding portion which protrudes further towards the one endmost bearing portion than the second rotational wheel is provided on the first rotational wheel.

2. Description of the Related Art

An engine is known in, for example, JP-A-8-261001 in which a drive gear provided on a camshaft is caused to mesh with a driven gear provided on an auxiliary device drive shaft which connects to a vacuum pump and a hydraulic pump.

Conventionally, an engine as described above is known in, for example, JP-A-3-117603.

The known conventional engine is a single overhead camshaft (SOHC) engine having a single camshaft. However, in attempting to apply an auxiliary device driving mechanism similar to the above conventional one to an engine having a pair of camshafts, a construction is desired to be provided which can drive auxiliary devices in such a manner as to make the engine as compact in size as possible while avoiding the interference of the auxiliary device driving mechanism with the pair of camshafts.

In the engine, in a case where the first rotational wheel fixed to the first camshaft at the position adjacent to the one endmost first bearing portion disposed at the one end of the cylinder head along the cylinder arrangement direction of the plurality of first bearing portions provided on the cylinder head at the positions spaced apart from each other in the cylinder arrangement direction has the cylindrical protruding portion which protrudes further towards the one endmost bearing portion than the second rotational wheel, in the event that the one endmost first bearing portion which rotatably supports the first camshaft and the one endmost second bearing portion which rotatably supports the second camshaft are set at the same position in a direction directed along the axes of the two camshafts, a space between the first and second rotational wheels and the one end of the cylinder head becomes large due to the first rotational wheel having the protruding portion, and this calls for the enlargement of the engine.

SUMMARY OF THE INVENTION

The present invention was made in view of the situation, and an object thereof is to provide an engine which can attain the required compactness in attempting to drive the auxiliary devices with the camshaft.

The present invention was made in view of the situation, and an object thereof is to provide an engine which enables the two rotational wheels to be disposed closer to the cylinder head so as to avoid the enlargement of the engine when the cylindrical protruding portion is provided on one of the rotational wheels which are interlocked and connected with each other which protruding portion protrudes further than the other rotational wheel.

With a view to attaining the object, according to a first aspect of the present invention, there is provided an engine having a first camshaft having a power input portion at one end thereof and a second camshaft interlocked and connected with the first camshaft at one end portion thereof have axes, these camshafts are parallel with each other and are rotatably supported on a cylinder head and in which a driven gear meshing with a drive gear provided at the other end portion of one of the first and second camshafts is provided on an auxiliary device drive shaft connecting to an auxiliary device mounted on an engine main body including the cylinder head, wherein an axis of the auxiliary device drive shaft is disposed between the first and second camshafts at a position closer to the cylinder head than a straight line connecting the axes of the two camshafts.

According to the construction provided by the first aspect of the present invention, an attempt to make the engine compact in size in a direction directed along the axis of a cylinder can be attained by making the auxiliary device drive shaft approach one of the pair of camshafts without expanding a space between the two camshafts.

In addition, with a view to attaining the object, according to a second aspect of the present invention, there is provided an engine having a first camshaft having a power input portion at one end thereof and a second camshaft interlocked and connected with the first camshaft at one end portion thereof have axes, these camshafts are parallel with each other and are rotatably supported on a cylinder head and in which a driven gear meshing with a drive gear provided at the other end portion of one of the first and second camshafts is provided on an auxiliary device drive shaft connecting to an auxiliary device mounted on an engine main body including the cylinder head, wherein a bearing portion for rotatably supporting the auxiliary device drive shaft is provided on the cylinder head at a position where part of the bearing portion overlaps the drive gear as viewed in a direction directed along an axis of a cylinder, and a cut-out is formed in the bearing portion for avoiding an interference of the bearing portion with the drive gear.

According to the construction provided by the second aspect of the present invention, the bearing portion for rotatably supporting the auxiliary device drive shaft can be disposed closer to the drive gear in a direction directed along the axis of the camshaft while avoiding a risk of the positions of the camshafts in the direction directed along the axis of the cylinder being made higher, which can contribute to the attainment of the attempt to make the engine compact in size.

With a view to attaining the object, according to a third aspect of the present invention, there is provided an engine in which a first camshaft having a power input portion at one end thereof and a second camshaft interlocked and connected with the first camshaft at one end portion thereof have axes which are parallel with each other and are rotatably supported on a cylinder head and in which a driven gear meshing with a drive gear provided at the other end portion of one of the first and second camshafts is provided on an auxiliary device drive shaft connecting to an auxiliary device mounted on an engine main body including the cylinder head, wherein a bearing member provided at a position where part of the bearing member overlaps the drive gear as viewed in a direction directed along an axis of a cylinder for rotatably supporting the auxiliary device drive shaft is fixed to the cylinder head with a plurality of bolts, some of the bolts are disposed so as to avoid positions where the bolts overlap the drive gear as viewed in the direction directed along the axis of the cylinder, whereas the remaining bolt is disposed at a position where the bolt overlaps the drive gear as viewed in the direction directed along the axis of the cylinder, and a portion of an outer circumference of the drive gear which faces the remaining bolt is disposed between a first imaginary plane which passes through top surfaces of the some bolts and which are parallel with the axes of the two camshafts and a second imaginary plane which passes through a top surface of the remaining bolt and which is parallel with the first imaginary plane.

According to the construction provided by the third aspect of the present invention, the auxiliary device drive shaft can be made to approach one of the pair of camshafts without expanding the space between the two camshafts, and the bearing member for rotatably supporting the auxiliary device drive shaft can be disposed closer to the driver gear in a direction directed along the axis of the camshaft while avoiding a risk of the positions of the camshafts in a direction directed along the axis of the cylinder being made higher, both of which can contribute to the attainment of the attempt to make the engine compact in size.

Furthermore, according to a fourth aspect of the present invention, there is provided an engine as set forth in any of the first to third aspects of the present invention, wherein helical gears meshing with each other are provided at the one end portions of the first and second camshafts, and wherein a thrust generated in the camshaft of the two camshafts on which the drive gear is provided by virtue of the meshing engagement of the helical gears so provided and a thrust generated in the camshaft on which the drive gear is provided by virtue of the meshing engagement of the drive gear and the driven gear which are both helical gears are set to be exerted in opposite directions to each other. According to this construction, the durability of the helical gears provided at the one end portions of the first and second camshafts and the gears for driving the auxiliary device can be enhanced.

With a view to attaining the object, according to a fifith aspect of the present invention, there is provided an engine in which first and second camshafts having axes which are parallel with each other along a cylinder arrangement direction are rotatably supported by pluralities of first and second bearing portions, respectively, which are provided for the respective camshafts on a cylinder head at positions spaced apart from each other in the cylinder arrangement direction, in which first and second rotational wheels which are interlocked and connected with each other are fixed to the first and second camshafts, respectively, at portions which protrude from the one endmost first and second bearing portions of the pluralities of the first and second bearing portions which are disposed at one end of the cylinder head along the cylinder arrangement direction, and in which a cylindrical protruding portion which protrudes further towards the one endmost bearing portion than the second rotational wheel is provided on the first rotational wheel, wherein the one endmost first bearing portion is disposed so as to be offset in a direction in which the one endmost first bearing portion goes away from the first rotational wheel relative to the one endmost second bearing portion.

According to the construction of the fifth aspect of the present invention, since the one endmost first bearing portion is disposed so as to be offset in the direction in which the one endmost first bearing portion goes away from the first rotational wheel relative to the one endmost second bearing portion, the first and second rotational wheels can be made to approach the cylinder head by disposing the protruding portion in a space produced in association with the offset disposition, thereby making it possible to attain an attempt to make the engine compact in size in the direction directed along the axes of the two camshafts.

According to a sixth aspect of the present invention, there is provided an engine as set forth in the fifth aspect of the present invention, wherein a driven gear which is the second rotational wheel is fixed to the second camshaft, and a drive gear which meshes with the driven gear and has the cylindrical protruding portion which protrudes further towards the one endmost first bearing portion than a meshing portion with the driven gear, the drive gear being the first rotational wheel, and a sprocket which is disposed on an opposite side to the one endmost first bearing portion with respect to the drive gear and around which a cam chain is wound are fixed to the first camshaft. According to the construction, the drive gear can be made to be placed closer to the cylinder head side, whereby the meshing portion between the drive gear and the driven gear and the sprocket can be made to approach the cylinder head, thereby making it possible to attain the attempt to make the engine compact in size in the direction directed along the axes of the two camshafts. Moreover, the fluctuation in torque generated in the second camshaft can be suppressed by making the driven gear into which the power from the crankshaft is not inputted directly approach the one endmost second bearing portion.

According to a seventh aspect of the present invention, there is provided an engine as set forth in the fifth or sixth aspect of the present invention, wherein pairs of inlet valve openings and pairs of exhaust valve openings which are all made to open to combustion chambers of cylinders, respectively, are provided in the cylinder head in such a manner that each pair of inlet valve openings and each pair of exhaust valve openings are aligned in a direction directed along the axes of the two camshafts, and wherein of the two exhaust valve openings or the two inlet valve openings which correspond to the first camshaft, the exhaust valve opening or the inlet valve opening which is situated closer to the one endmost first bearing portion is disposed so as to be offset towards an opposite direction to the first drive gear relative to the inlet valve opening or the exhaust valve opening situated closer to the one endmost second bearing portion of the two inlet valve openings or the two exhaust valve openings which correspond to the second camshaft. According to the construction, the offset disposition of the inlet valve opening and the exhaust valve opening can be implemented according to the offset of the one endmost first bearing portion relative to the one endmost second bearing portion, whereby the engine can be made more compact in size in the direction of the axes of the camshafts.

According to a eighth aspect of the present invention, there is provided an engine as set forth in a seventh aspect of the present invention, wherein the pair of exhaust valve openings are provided on the cylinder head on a side thereof which corresponds to the first camshaft, and wherein an inlet port provided in the cylinder head in such a manner as to communicate with the inlet valve opening situated closer to the one endmost second bearing portion of the pair of inlet valve openings which are provided on the cylinder head on a side thereof which corresponds to the second camshaft is formed into a shape which can generate a swirl of charge within the corresponding combustion chamber. According to the construction, in association with the offset disposition of the exhaust valve opening relative to the inlet valve opening, a swirl of charge can be formed in the combustion chamber in an effective fashion to thereby enhance the combustion efficiency.

According to a ninth aspect of the present invention, there is provided an engine as set forth in any of the fifth to eighth aspects of the present invention, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion. According to the construction, the protruding amount of the projections provided on the lower cam holder is made small at the portion corresponding to the one endmost first bearing portion, thereby making it possible to reduce the weight of the lower cam holder and hence the weight of the whole engine.

According to a tenth aspect of the present invention, there is provided an engine as set forth in the ninth aspect of the present invention, wherein a side of the one endmost first bearing portion which faces the protruding portion is disposed more inwardly in an axial direction of the first camshaft than a boss portion which is provided on the one endmost first bearing portion for allowing among a plurality of bolts used to fasten the lower cam holder to the cylinder head, a bolt corresponding to the one endmost first bearing portion to pass therethrough. According to the construction, the amount of offset of the one endmost first bearing portion relative to the one endmost second bearing portion can be made relatively large, thereby making it possible to make the engine more compact in size.

DETAILED DESCRIPTION OF THE PREFERRED EMBODIMENTS

A mode for carrying out the present invention will be described below based upon an embodiment of the present invention which is illustrated in the accompanying drawings.

Figure 1:
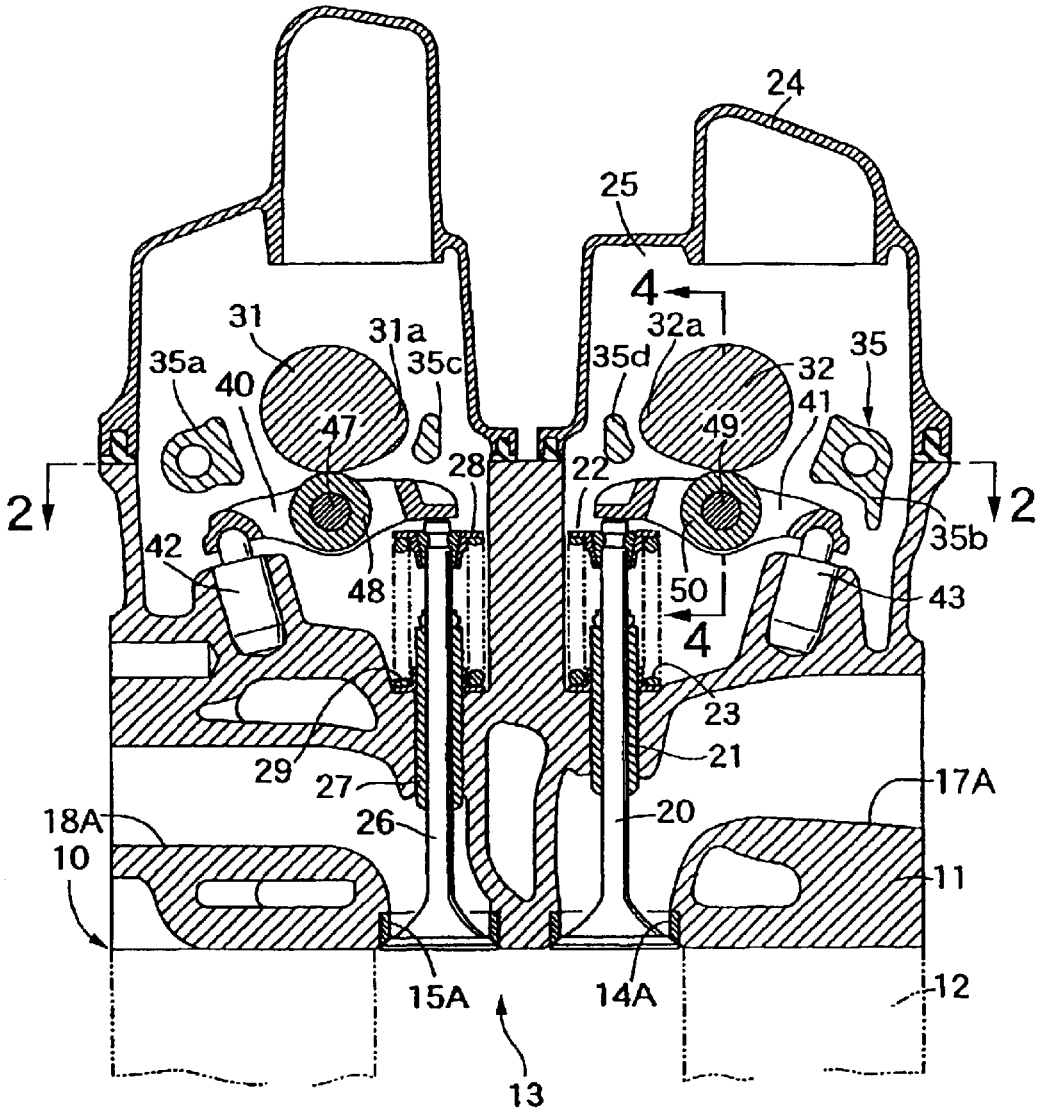
FIG. 1 is a vertical cross-sectional view of part of an engine, which is taken along the line 1—1 in FIG. 3.
Figure 2:
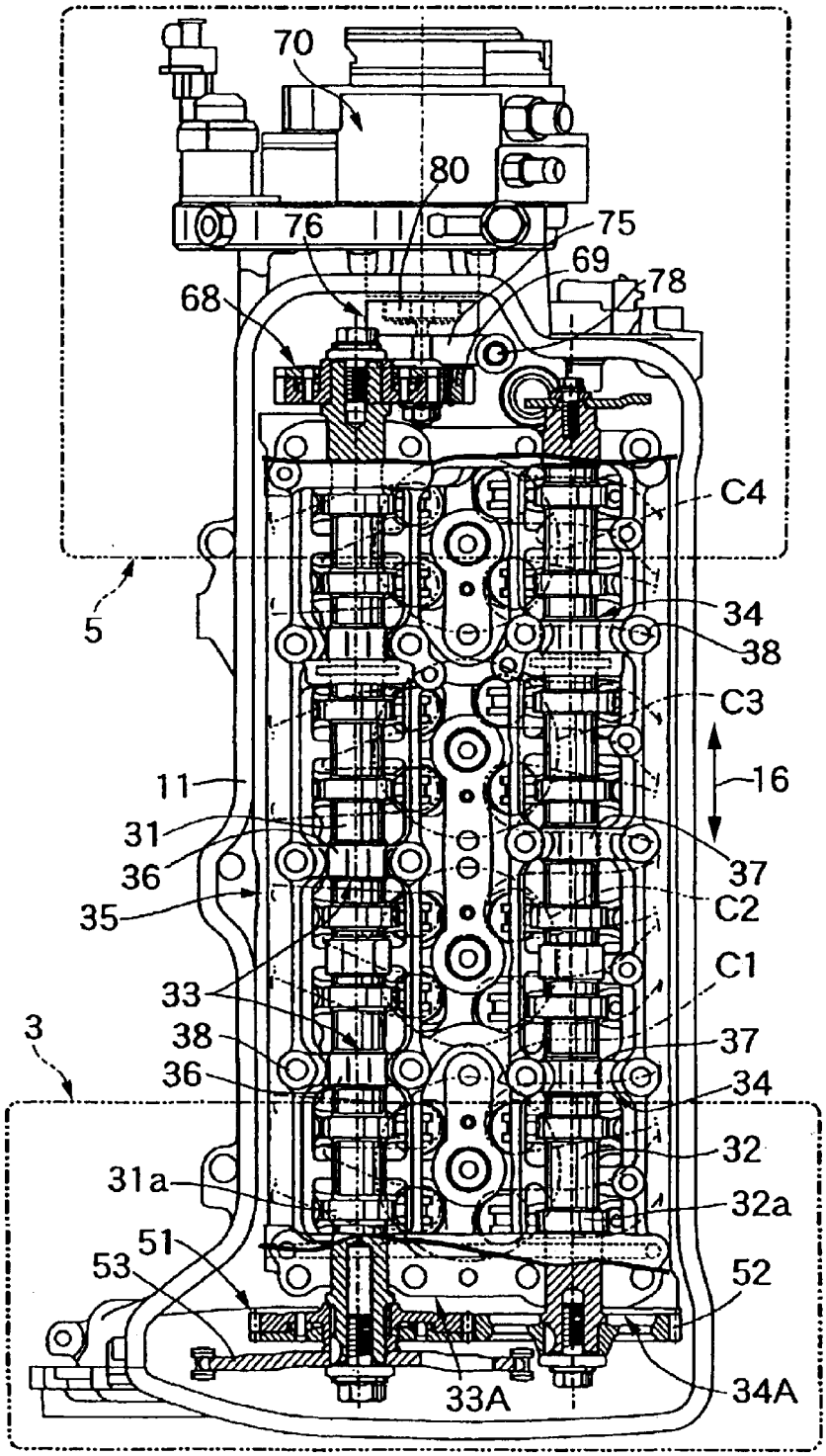
FIG. 2 is a view of the engine with a head cover being removed, as viewed in a direction indicated by arrows 2 in FIG. 1.
Figure 3:
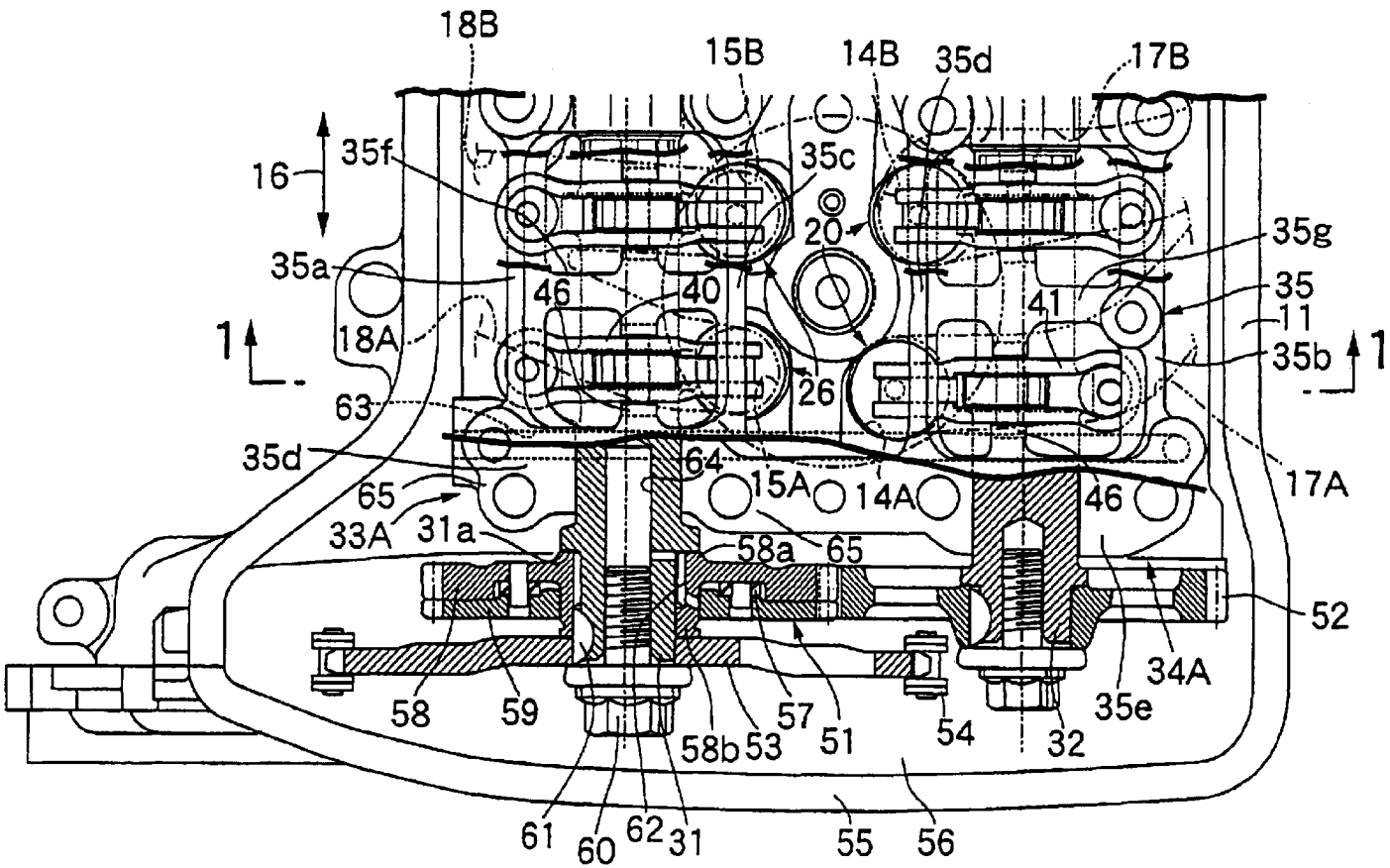
FIG. 3 is an enlarged view of a portion indicated by an arrow 3 in FIG. 2.
Figure 4:
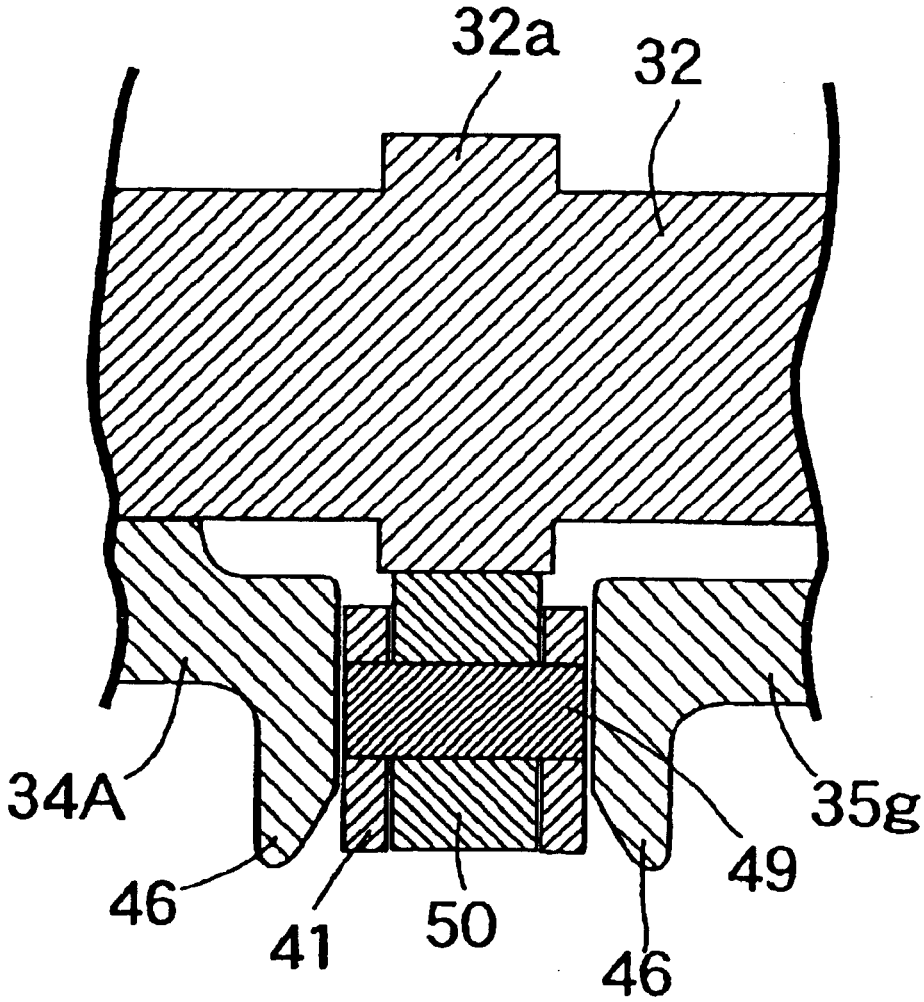
FIG. 4 is a cross-sectional view taken along the line 4—4 in FIG. 1.
Figure 5:
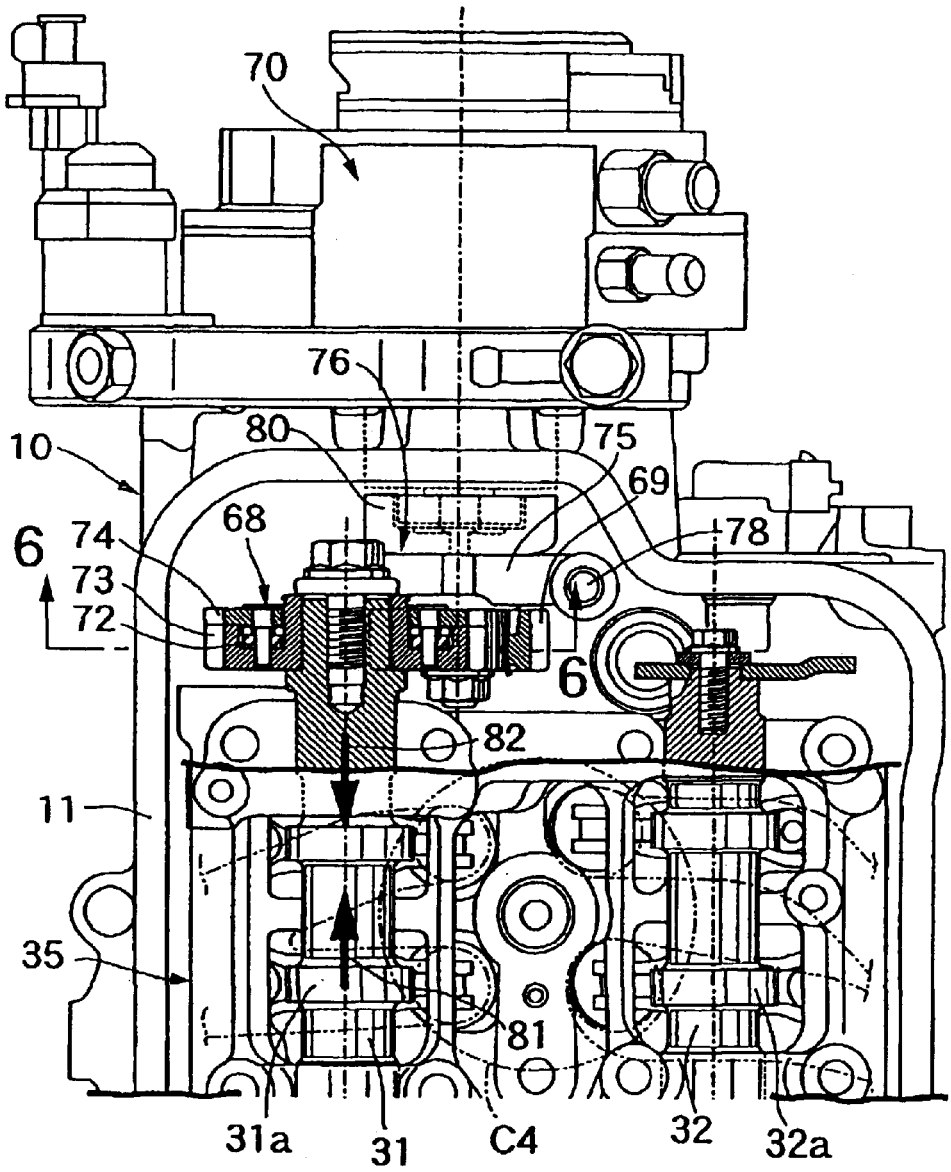
FIG. 5 is an enlarged view of a portion indicated by an arrow 5 in FIG. 2.
Figure 6:
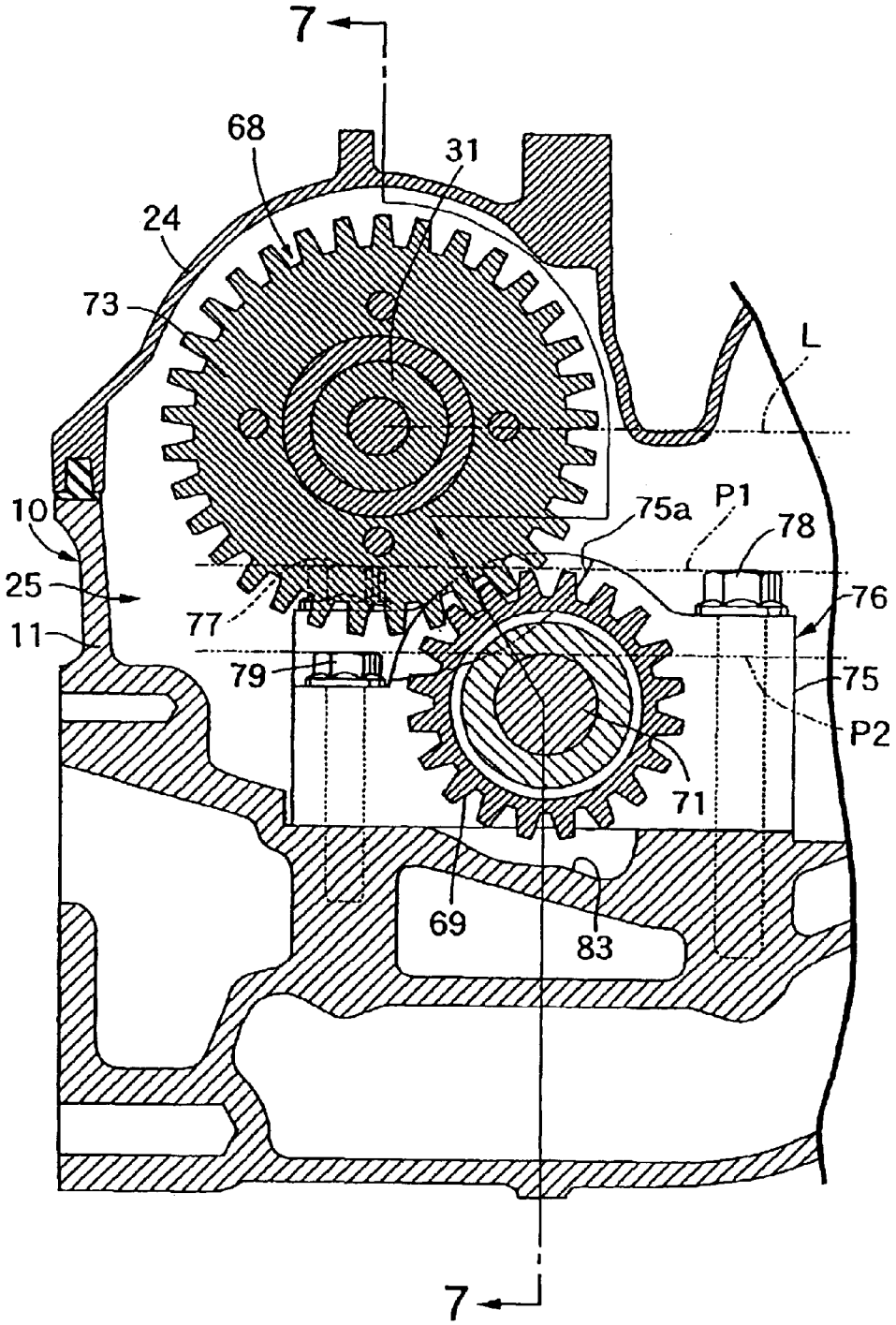
FIG. 6 is an enlarged cross-sectional view taken along the line 6—6 in FIG. 5.
Figure 7:
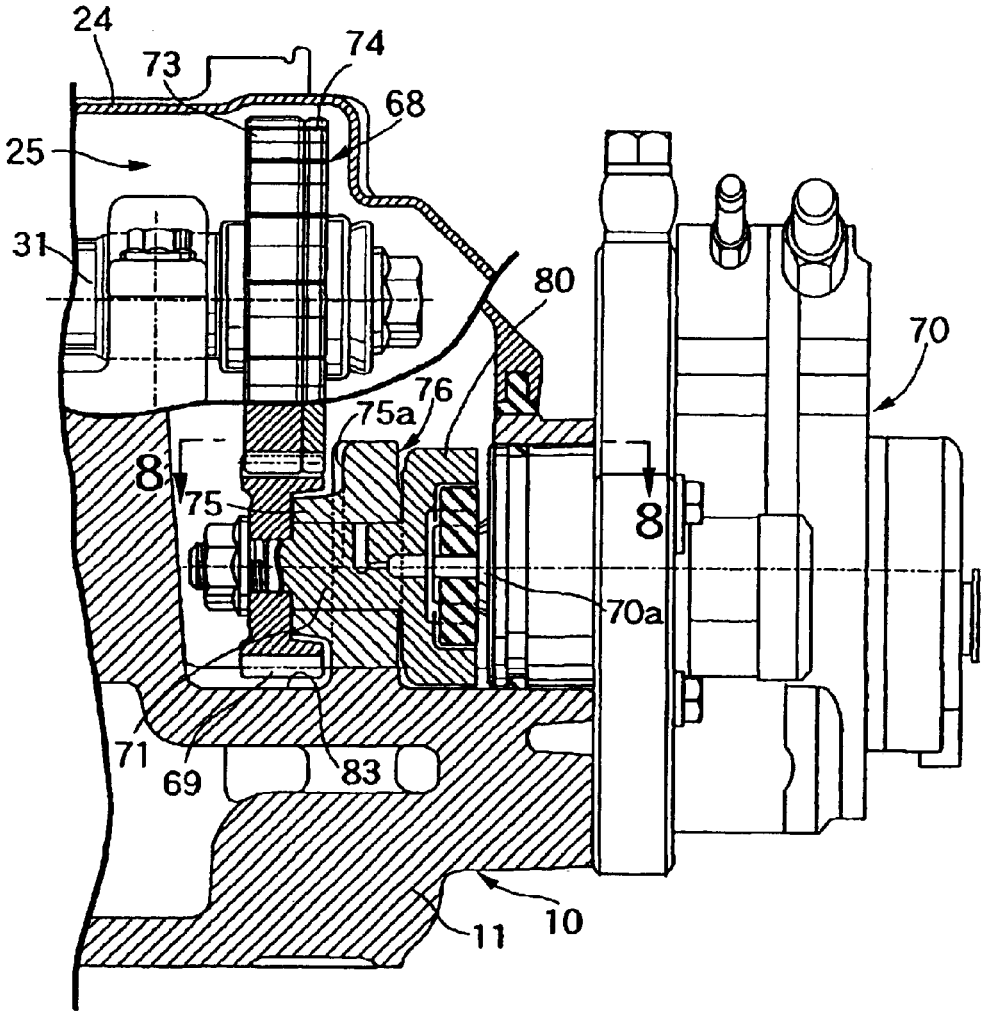
FIG. 7 is a cross-sectional view taken along the line 7—7 in FIG. 6; and, FIG. 8 is a cross-sectional view taken along the line 8—8 in FIG. 7.
Figure 8:
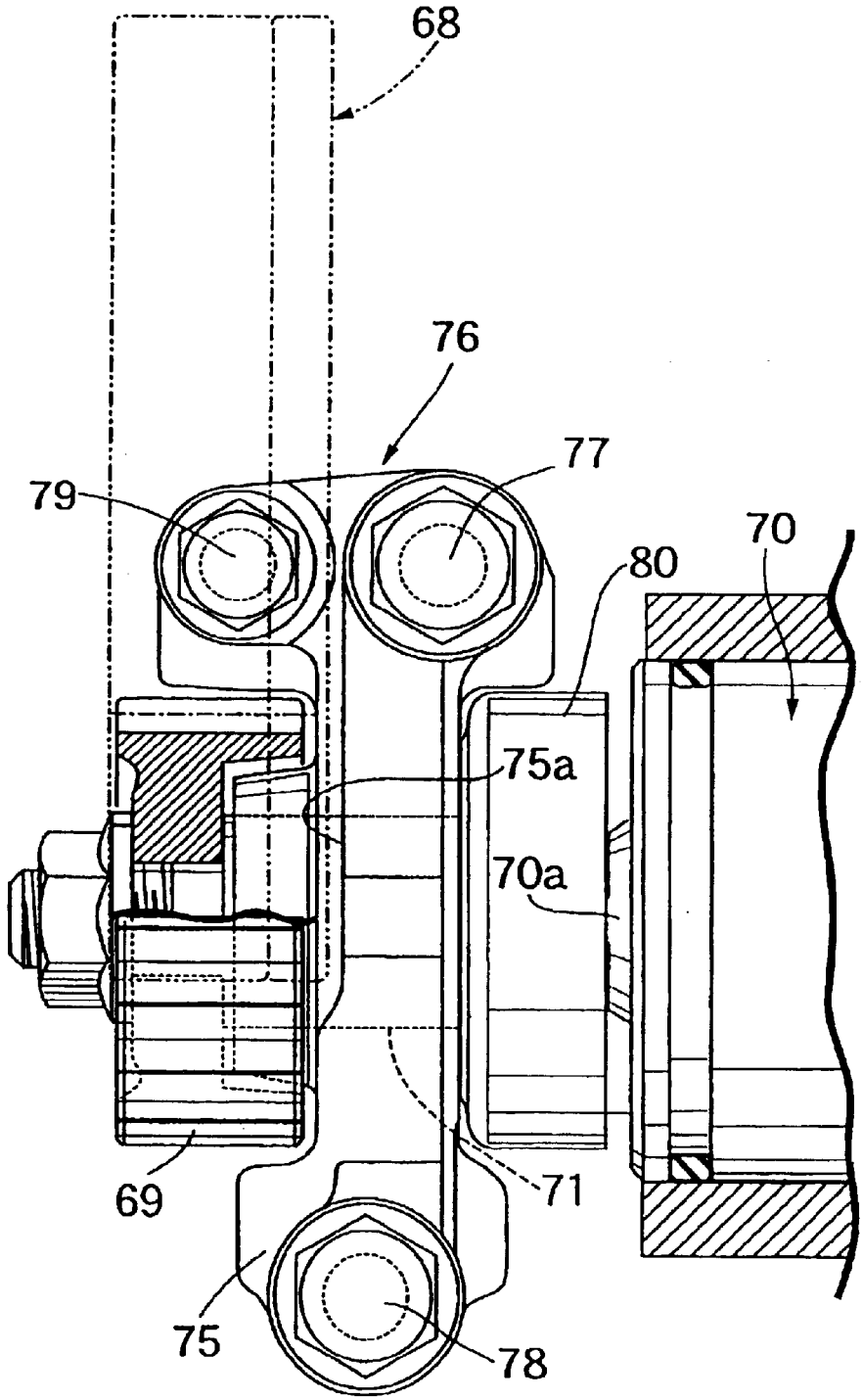

FIGS. 1 to 8 are drawings showing an embodiment of the present invention, in which FIG. 1 is a vertical cross-sectional view of part of an engine, which is taken along the line 1—1 in FIG. 3, FIG. 2 is a view of the engine with a head cover being removed, as viewed in a direction indicated by arrows 2 in FIG. 1, FIG. 3 is an enlarged view of a portion indicated by an arrow 3 in FIG. 2, FIG. 4 is a cross-sectional view taken along the line 4—4 in FIG. 1, FIG. 5 is an enlarged view of a portion indicated by an arrow 5 in FIG. 2, FIG. 6 is an enlarged cross-sectional view taken along the line 6—6 in FIG. 5, FIG. 7 is a cross-sectional view taken along the line 7—7 in FIG. 6, and FIG. 8 is a cross-sectional view taken along the line 8—8 in FIG. 7.

Firstly, in FIGS. 1 and 2, an engine shown therein is a compression ignition, double overhead camshafts (DOHC), in-line, four-cylinder engine. Combustion chambers 13 which top portions of respective pistons, not shown, are made to face are formed between a cylinder head 11 and a cylinder block 12 which constitute part of an engine main body 10 in such a manner as to correspond to first to fourth cylinders C1, C2, C3, C4, respectively, and pairs of inlet valve openings 14A, 14B and pairs of exhaust valve openings 15A, 15B which are all made to open to the combustion chambers 13, respectively, are provided in the cylinder head 11 in such a manner that each pair of inlet valve openings and each pair of exhaust valve openings correspond to each of the cylinders C1 to C4 which are aligned in a cylinder arrangement direction 16. In addition, pairs of inlet ports 17A, 17B which are allowed to communicate with the pairs of inlet valve openings 14A, 14B, respectively, and pairs of exhaust ports 18A, 18B which are allowed to communicate with the pairs of exhaust valve openings 15A, 15B, respectively, are provided in the cylinder head in such a manner that each pair of inlet ports and each pair of exhaust ports correspond to each of the cylinders, and fuel injection valves, not shown, are mounted in the cylinder head 11 in such a manner as to face central portions of the combustion chambers 13, respectively.

Inlet valves 20 which can open and close the respective inlet valve openings 14A, 14B are slidably fitted in guide tubes 21 provided in the cylinder head 11 with upper ends thereof being allowed to protrude from the guide tubes 21 into a valve chamber 25 formed between the cylinder head 11 and a head cover 24 which is connected to the cylinder head 11, and the respective inlet valves 20 are biased in a valve closing direction by valve springs 23 provided between retainers 22 provided at the upper ends of the respective inlet valves 20 and the cylinder head 11. In addition, exhaust valves 26 which can open and close the respective exhaust valve openings 15A, 15B are slidably fitted in guide tubes 27 provided in the cylinder head 11 with upper ends thereof being allowed to protrude from the guide tubes 27 into the valve chamber 25, and the respective exhaust valves 26 are biased in the valve closing direction by valve springs 29 provided between retainers 28 provided at the upper ends of the respective exhaust valves 26 and the cylinder head 11.

First and second camshafts 31, 32 having axes which are parallel with each other along the cylinder arrangement direction 16 are rotatably supported at positions spaced apart from one another in the cylinder arrangement direction 16 by pluralities of first and second bearing portions 33A, 33 and 34A, 34, respectively, which are provided on the cylinder head 11 for the respective camshafts, and the first bearing portions 33A, 33 and the second bearing portions 34A, 34 are made up of a lower cam holder 35 fastened to the cylinder head 11 and pluralities of exhaust-side and inlet-side upper cam holders 36 and 37 which are fastened to the lower cam holder 35, the upper cam holders 36, 37 being fastened to the cylinder head 11 together with the lower cam holder 35 with a plurality of bolts 38.

Referring to FIG. 3, as well, the lower cam holder 35 is such as to be formed into an integrated frame construction having as integral constituent components thereof a pair of outer longitudinal frame members 35*a*, 35*b* which extend along the cylinder arrangement direction 16 and a pair of inner longitudinal frame members 35*c*, 35*d* which are disposed inwardly of the outer longitudinal frame members 35*a*, 35*b*, respectively, and which extend in the cylinder arrangement direction 16. Five lower bearing portions 35*d* adapted for bearing a lower-half portion of the first camshaft 31 are provided between the outer longitudinal frame member 35*a* and the inner longitudinal frame member 35*c* which are situated on a side of the cylinder head 11 where the respective exhaust valves 26 are disposed in such a manner as to hold the respective cylinders C1 to C4 from both sides thereof, and the upper cam holders 36 on the exhaust side are fastened to the lower cam holder 35 in such a manner as to constitute the first bearing portions 33*a*, 33 in cooperation with the lower bearing portions 35*d*. In addition, five lower bearing portions 35*e* adapted for bearing a lower-half portion of the second camshaft 32 are provided between the outer longitudinal frame member 35*b* and the inner longitudinal frame member 35*d* which are situated on a side of the cylinder head 11 where the respective inlet valves 20 are disposed In such a manner as to hold the respective cylinders C1 to C4 from both sides thereof, and the upper cam holders 37 on the inlet side are fastened to the lower cam holder 35 in such a manner as to constitute the second bearing portions 34A, 34 in cooperation the lower bearing portions 35*e*.

The outer longitudinal frame member 35*a* and the inner longitudinal frame member 35*c* which are situated on the side where the respective exhaust valves 26 are disposed are interconnected by partition walls 35*f* between the plurality of first bearing portions 33A, 33 whereas the outer longitudinal frame member 35*b* and the inner longitudinal frame member 35*d* which are situated on the side where the inlet valves 20 are disposed are interconnected by partition walls 35*g* between the plurality of second bearing portions 34A, 34.

Exhaust-side rocker arms 40 which are pivot supported on the cylinder head 11 via hydraulic tappets 42 at one ends thereof so as to rock within planes intersecting at right angles with an axis of the first camshaft 31 are disposed between the first bearing portions 33A, 33 and the partition walls 35*f* which are all situated on the side where the respective exhaust valves 26 are disposed, and the other ends of the respective exhaust-side rocker arms 40 are brought into abutment with the upper ends of the respective exhaust valves 26, whereby the exhaust-side rocker arms 40 are interlocked and connected with the respective exhaust valves 26. In addition, inlet-side rocker arms 41 which are pivot supported on the cylinder head 11 via hydraulic tappets 43 at one ends thereof so as to rock within planes intersecting at right angles with an axis of the second camshaft 32 are disposed between the second bearing portions 34A, 34 and the partition walls 35*g* which are all situated on the side where the respective inlet valves 20 are disposed, and the other ends of the respective inlet-side rocker arms 41 are brought into abutment with the upper ends of the respective inlet valves 20, whereby the inlet-side rocker arms 41 are interlocked and connected with the respective inlet valves 20.

Referring to FIG. 4, as well, projections 46 which project toward the inlet-side rocker arms 41 are provided, respectively, on the second bearing portions 34A, 34 and the partition walls 35*g* which are all situated on the side of the cylinder head 11 where the respective inlet valves 20 are disposed, and the inlet-side rocker arms 41 are prevented from falling down by being held by the projections 46 so provided. In addition, projections 46 which project toward the exhaust-side rocker arms 40 are also provided, respectively, on the first bearing portions 33A, 33 and the partition walls 35*f* which are all situated on the side of the cylinder head 11 where the respective exhaust valves 26 are disposed, and the exhaust-side rocker arms 40 are prevented from falling down by being held by the projections 46 so provided.

A roller 48 is rotatably supported at a middle portion of the respective exhaust-side rocker arms 40 via a supporting shaft 47 having an axis which is parallel with the first camshaft 31, and a roller 50 is rotatably supported at a middle portion of the respective inlet-side rocker arms 41 via a supporting shaft 49 having an axis which is parallel with the second camshaft 32. The rollers 48, 50 are brought into rolling contact, respectively, with valve actuating cams 31*a*, 32*a* which are provided on the first and second camshafts 31, 32, respectively.

A first driven gear 52 which is a helical gear is provided on the second camshaft 32 at a portion thereof which protrudes from the one endmost second bearing portion 34A of the plurality of second bearing portions 34A, 34 which is disposed on the cylinder head 11 at a portion corresponding to an endmost portion of the one end of the second camshaft 32 along the cylinder arrangement direction 16, the first driven gear 52 functioning as a second rotational wheel, and fixed to the first camshaft 31 at a portion thereof which protrudes from the one endmost first bearing portion 33A of the plurality of first bearing portions 33A, 33 which is disposed on the cylinder head 11 at a portion corresponding to an endmost portion of the one end of the first camshaft 31 along the cylinder arrangement direction 16 are a first drive gear 51, which is a helical gear adapted for meshing with the first driven gear 52 and which has a cylindrical protruding portion 58*a* which protrudes further towards the one endmost first bearing portion 33A than a meshing portion where the first drive gear 51 meshes with the first driven gear 52 and a sprocket 53 which is disposed on an opposite side to the one endmost first bearing portion 33A with respect to the first drive gear 51 and around which a timing chain or a cam chain 54 is wound.

The one end portions of the first and second camshafts 31, 32 are such as to be disposed in a chain chamber 56 formed between the engine main body 10 including the cylinder head 11 and a chain cover 55, and the cam chain 54 adapted for running within the chain chamber 56 in order to transmit power from a crankshaft, not shown, is wound around the sprocket 53.

The first drive gear 51 is made up by combining first and second gears 58, 59 together using a gear-combination construction with a friction rubber 57 being interposed between the first and second gears 58, 59. The first gear 58 has cylindrical protruding portions 58*a*, 58*b* which are formed integrally on both sides of the first gear 58 as viewed in an axial direction thereof in such a manner as to concentrically surround the first camshaft 31, and these protruding portions 58*a*, 58*b* are held by an annular stepped portion 31*a* provided on the first camshaft 31 and the sprocket 53. A bolt 60 which is brought into engagement with the sprocket 53 is allowed to screw fit in the first camshaft 31 coaxially, and moreover, a key 61 is inserted between inner circumferences of the first gear 58 and the sprocket 53 and an outer circumference of the first camshaft 31, whereby the first drive gear 51 and the sprocket 53 are fixed to the first camshaft 31 with the bolt 60 and the key 61.

Incidentally, an object of the integral provision of the protruding portion 58*a* which protrudes further towards the one endmost first bearing portion 33A than the meshing portion where the first drive gear 51 and the first driven gear 52 mesh with each other on the first gear 58 is to form an oil passage 62 for guiding a lubricating oil to the meshing portion between the first drive gear 51 and the first driven gear 52 after allowing the lubricating oil to pass between the first and second gears 58, 59 between an inner circumferential surface of the first gear 58 and an outer circumferential surface of the first camshaft 31 to thereby avoid a portion where the bolt 60 screw fits in the first camshaft 31, and an oil passage 64 which connects an oil supply passage 63 provided in the lower cam holder 35 at a portion which corresponds to the one endmost first bearing portion 33A with the oil passage 62 is formed coaxially inside the first camshaft 31.

As is clearly shown in FIG. 3, the one endmost first bearing portion 33A is disposed so as to be offset in a direction in which the same bearing portion goes away from the first drive gear 51 relative to the one endmost second bearing portion 34A.

Moreover, of the two exhaust valve openings 15A, 15B which correspond to the first camshaft 31, the exhaust valve opening 15A which is situated closer to the one endmost first bearing portion 33A is disposed so as to be offset towards an opposite direction to the first drive gear 51 relative to the inlet valve opening 14A situated closer to the one endmost second bearing portion 34A of the two inlet valve openings 14A, 14B which correspond to the second camshaft 32.

Incidentally, the inlet port 17A provided in the cylinder head 11 in such a manner as to communicate with the inlet valve opening 14A situated closer to the one endmost second bearing portion 34A of the pair of inlet valve openings 14A, 14B which are provided on the cylinder head 11 on the side thereof which corresponds to the second camshaft 32 is formed into a shape which can generate a swirl of charge within the corresponding combustion chamber 13.

In addition, a space between the exhaust-side rocker arm 40 situated adjacent to the one endmost first bearing portion 33A and the one endmost first bearing portion 33A is set to be narrower than a space between the inlet-side rocker arm 41 situated adjacent to the one endmost second bearing portion 34A and the one endmost second bearing portion 34A.

Furthermore, a side of the one endmost first bearing portion 33A which faces the first drive gear 51 is disposed more inwardly in the axial direction of the first camshaft 31 than a pair of boss portions 65, 65 which are provided on the one endmost first bearing portion 33A for allowing among the plurality of bolts 38 used to fasten the lower cam holder 35 and the upper cam holders 36 to the cylinder head 11 the bolts 38 located at a portion corresponding to the one endmost first bearing portion 33A to pass therethrough.

Referring to FIGS. 5 to 8, as well, a second drive gear 68, which is a helical gear, is provided on the other end portion of the first camshaft 31, and a second driven gear 69, which is a helical gear, is provided on an auxiliary device drive shaft 71 connecting to a high-pressure fuel pump 70 mounted on the cylinder head 11 of the engine main body 10 as an auxiliary device. The second drive gear 68 is made up by combining third and fourth gears 73, 74 together using the gear-combination construction with a friction rubber 72 being interposed between the third and fourth gears 73, 74.

The auxiliary device drive shaft 71 is rotatably supported by a bearing portion 76 made up by fastening a bearing member 75 which is a separate member from the cylinder head 11 to the cylinder head 11 with three bolts 77, 78, 79 and is coupled to a rotational shaft 70*a* of the high-pressure fuel pump 70 via an Oldham's coupling 80.

Incidentally, an axis of the auxiliary device drive shaft 71 is disposed closer to the cylinder head 11 than a straight line L which connects axes of the first and second camshafts 31, 32, and the bearing portion 76 is provided on the cylinder head 11 at a position where the bearing portion 76 partly overlaps the second drive gear 68 as viewed in a direction directed along the axis of the cylinder with a cut-off 75*a* being formed in the bearing member 75 of the bearing portion 76 in order to avoid an interference of the bearing portion 76 with the second drive gear 68.

The two bolts 77, 78 of the three bolts 77, 78, 79 used to fasten the bearing member 75 constituting the bearing portion 76 to the cylinder head 11 are disposed on sides of the auxiliary device drive shaft 71 at positions where the bolts 77, 78 do not overlaps the second drive gear 68 as viewed in the direction directed along the axis of the cylinder, whereas the remaining bolt 79 is disposed so as to fasten the bearing member 75 to the cylinder head 11 at a position where the bolt 79 partly overlaps the second drive gear 68 as viewed in the direction directed along the axis of the cylinder with a view to enhancing the fastening rigidity of the bearing member 75 to the cylinder head 11.

Moreover, a portion of an outer circumferential surface of the second drive gear 68 which correspond to the remaining bolt 79 is disposed between a first imaginary plane P1 which passes through top surfaces of the two bolts 77, 78 which constitute part of the three bolts 77 to 79 and which is parallel with the axes of the first and second camshafts 31, 32 and a second imaginary plane P2 which passes through a top surface of the remaining bolt 79 and which is parallel with the first imaginary plane P1, and the cut-off 75*a* is formed in the bearing member 75 of the bearing portion 76 in such a manner as to avoid the interference with the second drive gear 68.

Incidentally, the first drive gear 51 and the first driven gear 52 which mesh with each other at the one end portions of the first and second camshafts 31, 32 are helical gears, and the second drive gear 68 provided at the other end portion of the first camshaft 31 to drive the high-pressure fuel pump 70 and the second driven gear 69 provided on the auxiliary device drive shaft 71 for meshing engagement with the second drive gear 69 are also helical gears. A thrust generated in the first camshaft 31 as indicated by an arrow 81 in FIG. 5 by virtue of the meshing engagement of the first drive gear 51 and the first driven gear 52 and a thrust generated in the first camshaft 31 as indicated by an arrow 82 in FIG. 5 by virtue of the meshing engagement of the second drive gear 68 and the second driven gear 69 are set to be exerted in opposite directions to each other.

Additionally, as is clearly shown in FIGS. 6 and 7, a recessed portion 83 is provided in the cylinder head 11 for accommodating part of the second driven gear 69 so that the height of the first camshaft 31 in the direction directed along the axis of the cylinder is made as low as possible, and this provision of the recessed portion 83 can contribute to the attainment of the attempt to make the engine compact in size. Moreover, a meshing portion where the second drive gear 68 and the second driven gear 69 mesh with each other can be lubricated by scooping oil collected in the recessed portion 83 to the meshing portion with the second driven gear 68.

Next, the function of the embodiment will be described. The first driven gear 52 is provided on the second camshaft 32 at the portion thereof which protrudes from the one endmost second bearing portion 34A disposed on the cylinder head 11 at the portion corresponding to the endmost portion of the one end of the second camshaft 32 along the cylinder arrangement direction 16 of the plurality of second bearing portions 34A, 34 which are provided on the cylinder head 11 at the positions spaced apart from one another along the cylinder arrangement direction 16 for the second camshaft 32, and fixed to the first camshaft 31 at the portion thereof which protrudes from the one endmost first bearing portion 33A disposed on the cylinder head 11 at the portion corresponding to the endmost portion of the one end of the first camshaft 31 along the cylinder arrangement direction 16 of the plurality of first bearing portions 33A, 33 which are provided on the cylinder head 11 at the positions spaced apart from one another along the cylinder arrangement direction 16 for the first camshaft 31 is the first drive gear 51 which meshes with the first driven gear 52 and which has the cylindrical protruding portion 58*a* which protrudes further towards the one endmost first bearing portion 33A than the meshing portion where the first drive gear 51 meshes with the first driven gear 52, the one endmost first bearing portion 33A being disposed so as to be offset in the direction in which the same bearing portion goes away from the first drive gear 51 relative to the one endmost second bearing portion 34A.

Consequently, the first drive gear 51 and the first driven gear 52 can be disposed closer to the cylinder head 11 by disposing the protruding portion 58*a* in a space produced in association with the offset disposition of the one endmost first bearing portion 33A relative to the one endmost second bearing portion 34A, thereby making it possible to attempt to make the engine compact in size.

Moreover, the sprocket 53 from which the power from the crankshaft is inputted is fixed to the first camshaft 31 on the opposite side to the one endmost first bearing portion 33A with respect to the first drive gear 51, and by allowing the sprocket 53 to approach the cylinder head 11, the engine can be made more compact in size in the direction directed along the axes of the two camshafts 31, 32. In addition, the torque fluctuation in the second camshaft 32 can be suppressed by allowing the first driven gear 52 provided on the inlet valve 20 side second camshaft 32 into which the power from the crankshaft is not inputted directly to approach the one endmost second bearing portion 34A.

Additionally, the pair of inlet valve openings 14A, 14B and the pair of exhaust valve openings 15A, 15B which are all made to open to the combustion chamber 13 and are aligned in the direction directed along the axes of the two camshafts 31, 32, respectively, are provided for the respective cylinders C1 to C4. The exhaust valve opening 15A disposed closer to the one endmost first bearing portion 33A of the two exhaust valve openings 15A, 15B which correspond to the first camshaft 31 is disposed to be offset towards the opposite side to the first drive gear 51 relative to the inlet valve opening 14A disposed closer to the one endmost second bearing portion 34A of the two inlet valve openings 14A, 14B which correspond to the second camshaft 32. Thus, since the offset disposition of the exhaust valve opening 15A relative to the inlet valve opening 14A is implemented according to the offset of the one endmost first bearing portion 33A relative to the one endmost second bearing portion 34A, the engine can be made more compact in size in the axial direction of the camshafts 31, 32.

Moreover, the pair of exhaust valve openings 15A, 15B are provided on the cylinder head 11 on the side which corresponds to the first camshaft 31, and the inlet port 17A provided in the cylinder head 11 in such a manner as to communicate with the inlet valve opening 14A disposed closer to the one endmost second bearing portion 34A of the pair of inlet valve openings 14A, 14B which are provided on the cylinder head 11 on the side which corresponds to the second camshaft 32 is formed into the shape which generate a swirl of charge inside the combustion chamber 13. Thus, the formation of the inlet port 17A as well as the offset disposition of the exhaust valve opening 15A relative to the inlet valve opening 14A can form a swirl of charge in the combustion chamber 13 in an effective fashion so as to enhance the combustion efficiency.

In addition, the plurality of exhaust-side and inlet-side rocker arms 40, 41 which are pivot supported at the one ends thereof in such a manner as to rock within the planes which intersect at right angles with the axes of the first and second camshafts 31, 32 are interlocked and connected with the exhaust valves 26 and the inlet valves 20 at the other ends thereof. Furthermore, the respective first and second bearing portions 33A, 33, 34A, 34 are made up of the lower cam holder 35 having the projections 46 which are disposed on the sides of the exhaust-side and inlet-side rocker arms 40, 41 to prevent the respective rocker arms 40, 41 from falling down and the plurality of exhaust-side and inlet-side upper cam holders 36, 37 which are all fastened to the lower cam holder 35. Moreover, the space between the exhaust-side rocker arm 40 adjacent to the one endmost first bearing portion 33A and the one endmost first bearing portion 33A is set to be narrower than the space between the inlet-side rocker arm 41 adjacent to the one endmost second bearing portion 34A and the one endmost second bearing portion 34A. Due to these, by allowing the one endmost first bearing portion 33A to approach the exhaust-side rocker arm 40, the protruding amount of the projection 46 provided on the lower cam holder 35 at the portion corresponding to the one endmost first bearing portion 33A can be made small, whereby an attempt to reduce the weight of the lower cam holder 35 and hence the weight of the engine can be attained.

Furthermore, since the side of the one endmost first bearing portion 33A which faces the first drive gear 51 is disposed more inwardly in the axial direction of the first camshaft 31 than the pair of boss portions 65, 65 which are provided on the one endmost first bearing portion 33A for allowing, among the plurality of bolts 38 used to fasten the lower cam holder 35 and the exhaust-side upper cam holders 36 to the cylinder head 11, the bolts 38 located at the portion corresponding to the one endmost first bearing portion 33A to pass therethrough, the offset amount of the one endmost first bearing portion 33A relative to the one endmost second bearing portion 34A is made relatively large, thereby making it possible to make the engine more compact in size.

Furthermore, the second driven gear 69 which meshes with the second drive gear 68 provided at the other end portion of the first camshaft 31 is provided on the auxiliary device drive shaft 71 connecting to the high-pressure fuel pump 70 mounted on the cylinder head 11 of the engine main body 10. The axis of the auxiliary device drive shaft 71 is disposed closer to the cylinder head 11 than the straight line L which connects the axes of the first and second camshafts 31, 32 between the two camshafts 31, 32.

Consequently, the auxiliary device drive shaft 71 can be made to approach the first camshaft 31 without expanding the space between the first and second camshafts 31, 32, thereby making it possible to attain the attempt to make the engine compact in size in the direction directed along the axis of the cylinder.

In addition, the bearing portion 76 for rotatably supporting the auxiliary device drive shaft 71 is provided on the cylinder head 11 at the position where the bearing portion 76 partly overlaps the second drive gear 68 as viewed in the direction directed along the axis of the cylinder. The cut-out 75*a* is formed in the bearing portion 76 in order to avoid the interference of the bearing portion 76 with the second drive gear 68. Therefore, the bearing portion 76 for rotatably supporting the auxiliary device drive shaft 71 can be disposed closer to the second drive gear 68 in the direction along the axis of the first camshaft 31 while avoiding the risk of the positions of the camshafts 31, 32 in the direction directed along the axis of the cylinder being made higher, which can also contribute to the attainment of the attempt to make the engine compact in size.

Incidentally, the bearing portion 76 is such as to be made up by fastening the bearing member 75 for rotatably supporting the auxiliary device drive shaft 71 to the cylinder head 11 with the three bolts 77, 78, 79. The two bolts 77, 78 of the three bolts 77 to 79 are disposed on the sides of the auxiliary device drive shaft 71 at the positions where the bolts do not overlap the second drive gear 68 as viewed in the direction directed along the axis of the cylinder, whereas the remaining bolt 79 is disposed so as to fasten the bearing member 75 to the cylinder head 11 at the position where the bolt partly overlaps the second drive gear 68 as viewed in the direction directed along the axis of the cylinder in order to enhance the fastening rigidity of the bearing member 75 to the cylinder head 11.

Moreover, the portion of the outer circumferential surface of the second drive gear 68 which faces the remaining bolt 79 is disposed between the first imaginary plane P1 which passes through the top surfaces of the two bolts 77, 78, which are some of the respective bolts 77 to 79, and which is parallel with the axes of the first and second camshafts 31, 32 and the second imaginary plane P2 which passes through the top surface of the remaining bolt 79 and which is parallel with the first imaginary plane P1.

Consequently, the auxiliary device drive shaft 71 can be made to approach the first camshaft 31, which is one of the first and second camshafts 31, 32, without expanding the space between the two camshafts 31, 32, and the bearing member 75 can be disposed closer to the second drive gear 68 in the direction directed along the axes of the camshafts 31, 32 while avoiding the risk of the positions of the camshafts in the direction directed along the axis of the cylinder being made higher, both of which can also contribute to the attainment of the attempt to make the engine compact in size.

Furthermore, the first drive gear and the first driven gear 52 which are provided at the one end portions of the first and second camshafts 31, 32 so as to mesh with each other are helical gears. The thrust generated in the first camshaft 31 by virtue of the mesh engagement of the first drive gear 51 and the first driven gear 52 and the thrust generated in the first camshaft 31 by virtue of the mesh engagement of the second drive gear 68 and the second driven gear 69 which are both helical gears are set to be exerted in the opposite directions to each other, thereby making it possible to enhance the durability of the first drive gear 51 and the first driven gear 52 which are provided at the one end portions of the first and second camshafts 31, 32 and the second drive gear 68 and the second driven gear 69 which are used to drive the high-pressure fuel pump 70.

Thus, while the embodiment of the present invention has been described heretofore, the present invention is not limited to the embodiment but may be modified in various ways without departing from the spirit and scope of the present invention which are described under the claims thereof.

For example, while the high-pressure fuel pump 70 which is an auxiliary device is mounted on the cylinder head 11 in the aforesaid embodiment, the high-pressure fuel pump 70 may be mounted on the other constituent components of the engine main body 10 than the cylinder head 11, for example, on the cylinder block 12. As this occurs, the axis of the auxiliary device drive shaft 71 may only have to be disposed closer to the cylinder head 11 than the straight line L which connects the axes of the two camshafts 31, 32 between the both camshafts 31, 32.

In addition, the present invention may be applied to a boat propelling marine engine such as an outboard engine in which the axis of a crankshaft becomes vertical.

The present invention may be applied to, for example, a boat propelling marine engine such as an outboard engine in which the axis of a crankshaft becomes vertical.

Thus, according to the first aspect of the present invention, the auxiliary device drive shaft can be made to approach one of the pair of camshafts without expanding the space between the two camshafts, thereby making it possible to attain the attempt to make the engine compact in size in the direction directed along the axis of the cylinder.

In addition, according to the second aspect of the present invention, the bearing portion for rotatably supporting the auxiliary device rotating shaft can be disposed closer to the drive gear in the direction directed along the axes of the camshafts while avoiding the risk of the positions of the camshafts in the direction directed along the axis of the cylinder being made higher, which can contribute to the attainment of the attempt to make the engine compact in size.

According to the third aspect of the present invention, the auxiliary device drive shaft can be made to approach the one of the pair of camshafts without expanding the space between the two camshafts, and the bearing member for rotatably supporting the auxiliary device drive shaft can be made to approach the drive gear in the direction directed along the axes of the camshafts while avoiding the risk of the positions of the camshafts in the direction directed along the axis of the cylinder being made higher, both of which can also contribute to the attainment of the attempt to make the engine compact in size.

Furthermore, according to the fourth aspect of the present invention, the durability of the helical gears provided at the one end portions of the first and second camshafts and the gears used to drive the auxiliary device can be enhanced.

Thus, according to the fifth aspect of the present invention, since the one endmost first bearing portion is disposed so as to be offset in the direction in which the one endmost first bearing portion goes away from the first rotational wheel relative to the one endmost second bearing portion, the first and second rotational wheels can be made to approach the cylinder head by disposing the protruding portion in a space produced in association with the offset deposition, thereby making it possible to attain an attempt to make the engine compact in size in the direction directed along the axes of the two camshafts.

In addition, according to the sixth aspect of the present invention, the drive gear can be made to be placed closer to the cylinder head side, whereby the meshing portion between the drive gear and the driven gear and the sprocket can be made to approach the cylinder head, thereby making it possible to attain the attempt to make the engine compact in size in the direction directed along the axes of the two camshafts. Moreover, the fluctuation in torque generated in the second camshaft can be suppressed by making the driven gear into which the power from the crankshaft is not inputted directly approach the one endmost second bearing portion.

According to the seventh aspect of the present invention, the offset disposition of the inlet valve opening and the exhaust valve opening can be implemented according to the offset of the one endmost first bearing portion relative to the one endmost second bearing portion, whereby the engine can be made more compact in size in the direction of the axes of the camshafts.

According to the eighth aspect of the present invention, a swirl of charge can be formed in the combustion chamber in an effective fashion to thereby enhance the combustion efficiency.

According to the ninth aspect of the present invention, the protruding amount of the projections provided on the lower cam holder is made small at the portion corresponding to the one endmost first bearing portion by making the one endmost first bearing portion approach the exhaust-side rocker arm, thereby making it possible to reduce the weight of the lower cam holder and hence the weight of the whole engine.

Furthermore, according to the tenth aspect of the present invention, the amount of offset of the one endmost first bearing portion relative to the one endmost second bearing portion can be made relatively large, thereby making it possible to make the engine more compact in size.

What is claimed is:

1. An engine comprising:

a first camshaft having a power input portion at one end thereof;

a second camshaft interlocked and connected with the first camshaft at one end portion thereof, the first and second camshaft having axes which are parallel with each other and are rotatably supported on a cylinder head;

a driven gear meshing with a drive gear provided at the other end portion of one of the first and second camshafts; and an auxiliary device drive shaft connecting to an auxiliary device mounted on an engine main body including the cylinder head, wherein a bearing portion for rotatably supporting the auxiliary device drive shaft is provided on the cylinder head at a position where part of the bearing portion overlaps the drive gear as viewed in a direction directed along an axis of a cylinder, and wherein a cut-out is formed in the bearing portion for avoiding an interference of the bearing portion with the drive gear.

2. An engine as set forth in claim 1, wherein helical gears meshing with each other are provided at the one end portions of the first and second camshafts, and wherein a thrust generated in the camshaft of the two camshafts on which the drive gear is provided by virtue of the meshing engagement of the helical gears so provided and a thrust generated in the camshaft on which the drive gear is provided by virtue of the meshing engagement of the drive gear and the driven gear which are both helical gears are set to be exerted in opposite directions to each other.

3. An engine comprising:

a first camshaft having a power input portion at one end thereof;

a second camshaft interlocked and connected with the first camshaft at one end portion thereof, the first and second camshaft having axes which are parallel with each other and are rotatably supported on a cylinder head;

a driven gear meshing with a drive gear provided at the other end portion of one of the first and second camshafts; and an auxiliary device drive shaft connecting to an auxiliary device mounted on an engine main body including the cylinder head, wherein a bearing member provided at a position where part of the bearing member overlaps the drive gear as viewed in a direction directed along an axis of a cylinder for rotatably supporting the auxiliary device drive shaft is fixed to the cylinder head with a plurality of bolts, in that some of the bolts are disposed so as to avoid positions where the bolts overlap the drive gear as viewed in the direction directed along the axis of the cylinder, whereas the remaining bolt is disposed at a position where the bolt overlaps the drive gear as viewed in the direction directed along the axis of the cylinder, and wherein a portion of an outer circumference of the drive gear which faces the remaining bolt is disposed between a first imaginary plane which passes through top surfaces of the some bolts and which are parallel with the axes of the two camshafts and a second imaginary plane which passes through a top surface of the remaining bolt and which is parallel with the first imaginary plane.

4. An engine as set forth in claim 3, wherein helical gears meshing with each other are provided at the one end portions of the first and second camshafts, and wherein a thrust generated in the camshaft of the two camshafts on which the drive gear is provided by virtue of the meshing engagement of the helical gears so provided and a thrust generated in the camshaft on which the drive gear is provided by virtue of the meshing engagement of the drive gear and the driven gear which are both helical gears are set to be exerted in opposite directions to each other.

5. An engine comprising:

a first camshaft having a power input portion at one end thereof;

a second camshaft interlocked and connected with the first camshaft at one end portion thereof, the first and second camshaft having axes which are parallel with each other and are rotatably supported on a cylinder head;

a driven gear meshing with a drive gear provided at the other end portion of one of the first and second camshafts; and an auxiliary device drive shaft connecting to an auxiliary device mounted on an engine main body including the cylinder head, wherein an axis of the auxiliary device drive shaft is disposed between the first and second camshafts at a position being closer to the cylinder head than a straight line connecting the axes of the two camshafts; and wherein the first and second camshafts having axes which are parallel with each other along a cylinder arrangement direction are rotatably supported by pluralities of first and second bearing portions, respectively, which are provided for the respective camshafts on a cylinder head at positions spaced apart from each other in the cylinder arrangement direction, in which first and second rotational wheels which are interlocked and connected with each other are fixed to the first and second camshafts, respectively, at portions which protrude from the one endmost first and second bearing portions of the pluralities of the first and second bearing portions which are disposed at one end of the cylinder head along the cylinder arrangement direction, and in which a cylindrical protruding portion which protrudes further towards the one endmost bearing portion than the second rotational wheel is provided on the first rotational wheel, and wherein the one endmost first bearing portion is disposed so as to be offset in a direction in which the one endmost first bearing portion goes away from the first rotational wheel relative to the one endmost second bearing portion.

6. An engine as set forth in claim 5, wherein a driven gear which is the second rotational wheel is fixed to the second camshaft, and wherein a drive gear which meshes with the driven gear and has the cylindrical protruding portion which protrudes further towards the one endmost first bearing portion than a meshing portion with the driven gear, the drive gear being the first rotational wheel, and a sprocket which is disposed on an opposite side to the one endmost first bearing portion with respect to the drive gear and around which a cam chain is wound are fixed to the first camshaft.

7. An engine as set forth in claim 6, wherein pairs of inlet valve openings and pairs of exhaust valve openings which are all made to open to combustion chambers of cylinders, respectively, are provided in the cylinder head in such a manner that each pair of inlet valve openings and each pair of exhaust valve openings are aligned in a direction directed along the axes of the two camshafts, and wherein of the two exhaust valve openings or the two inlet valve openings which correspond to the first camshaft, the exhaust valve opening or the inlet valve opening which is situated closer to the one endmost first bearing portion is disposed so as to be offset towards an opposite direction to the first drive gear relative to the inlet valve opening or the exhaust valve opening situated closer to the one endmost second bearing portion of the two inlet valve openings or the two exhaust valve openings which correspond to the second camshaft.

8. An engine as set forth in claim 7, wherein the pair of exhaust valve openings are provided on the cylinder head on a side thereof which corresponds to the first camshaft, and wherein an inlet port provided in the cylinder head in such a manner as to communicate with the inlet valve opening situated closer to the one endmost second bearing portion of the pair of inlet valve openings which are provided on the cylinder head on a side thereof which corresponds to the second camshaft is formed into a shape which can generate a swirl of charge within the corresponding combustion chamber.

9. An engine as set forth in claim 8, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion.

10. An engine as set forth in claim 9, wherein a side of the one endmost first bearing portion which faces the protruding portion is disposed more inwardly in an axial direction of the first camshaft than a boss portion which is provided on the one endmost first bearing portion for allowing among a plurality of bolts used to fasten the lower cam holder to the cylinder head, a bolt corresponding to the one endmost first bearing portion to pass therethrough.

11. An engine as set forth in claim 7, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion.

12. An engine as set forth in claim 11, wherein a side of the one endmost first bearing portion which faces the protruding portion is disposed more inwardly in an axial direction of the first camshaft than a boss portion which is provided on the one endmost first bearing portion for allowing among a plurality of bolts used to fasten the lower cam holder to the cylinder head, a bolt corresponding to the one endmost first bearing portion to pass therethrough.

13. An engine as set forth in claim 6, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion.

14. An engine as set forth in claim 13, wherein a side of the one endmost first bearing portion which faces the protruding portion is disposed more inwardly in an axial direction of the first camshaft than a boss portion which is provided on the one endmost first bearing portion for allowing among a plurality of bolts used to fasten the lower cam holder to the cylinder head, a bolt corresponding to the one endmost first bearing portion to pass therethrough.

15. An engine as set forth in claim 5, wherein pairs of inlet valve openings and pairs of exhaust valve openings which are all made to open to combustion chambers of cylinders, respectively, are provided in the cylinder head in such a manner that each pair of inlet valve openings and each pair of exhaust valve openings are aligned in a direction directed along the axes of the two camshafts, and wherein of the two exhaust valve openings or the two inlet valve openings which correspond to the first camshaft, the exhaust valve opening or the inlet valve opening which is situated closer to the one endmost first bearing portion is disposed so as to be offset towards an opposite direction to the first drive gear relative to the inlet valve opening or the exhaust valve opening situated closer to the one endmost second bearing portion of the two inlet valve openings or the two exhaust valve openings which correspond to the second camshaft.

16. An engine as set forth in claim 15, wherein the pair of exhaust valve openings are provided on the cylinder head on a side thereof which corresponds to the first camshaft, and wherein an inlet port provided in the cylinder head in such a manner as to communicate with the inlet valve opening situated closer to the one endmost second bearing portion of the pair of inlet valve openings which are provided on the cylinder head on a side thereof which corresponds to the second camshaft is formed into a shape which can generate a swirl of charge within the corresponding combustion chamber.

17. An engine as set forth in claim 16, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion.

18. An engine as set forth in claim 17, wherein a side of the one endmost first bearing portion which faces the protruding portion is disposed more inwardly in an axial direction of the first camshaft than a boss portion which is provided on the one endmost first bearing portion for allowing among a plurality of bolts used to fasten the lower cam holder to the cylinder head, a bolt corresponding to the one endmost first bearing portion to pass therethrough.

19. An engine as set forth in claim 15, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion.

20. An engine as set forth in claim 19, wherein a side of the one endmost first bearing portion which faces the protruding portion is disposed more inwardly in an axial direction of the first camshaft than a boss portion which is provided on the one end most first bearing portion for allowing among a plurality of bolts used to fasten the lower cam holder to the cylinder head, a bolt corresponding to the one endmost first bearing portion to pass therethrough.

21. An engine as set forth in claim 5, wherein pluralities of exhaust-side and inlet-side rocker arms which are pivot supported at one ends thereof in such a manner as to rock within planes which intersect at right angles with the axes of the two camshafts are interlocked and connected with exhaust valves and inlet valves at the other ends thereof, wherein the respective bearing portions are made up of a lower cam holder having projections which are disposed on sides of the exhaust-side and inlet-side rocker arms to prevent the respective rocker arms from falling down and pluralities of exhaust-side and inlet-side upper cam holders which are all fastened to the lower cam holder, and wherein a space between the exhaust-side rocker arm adjacent to the one endmost first bearing portion and the one endmost first bearing portion is set to be narrower than a space between the inlet-side rocker arm adjacent to the one endmost second bearing portion and the one endmost second bearing portion.

22. An engine as set forth in claim 21, wherein a side of the one endmost first bearing portion which faces the protruding portion is disposed more inwardly in an axial direction of the first camshaft than a boss portion which is provided on the one endmost first bearing portion for allowing among a plurality of bolts used to fasten the lower cam holder to the cylinder head, a bolt corresponding to the one endmost first bearing portion to pass therethrough.

* * * * *